United States Patent [19]

Lemon

[11] Patent Number: 4,862,508

[45] Date of Patent: Aug. 29, 1989

[54] METHOD FOR LARGE-SCALE MULTIPLE SOURCE SOUND REINFORCEMENT

[75] Inventor: John Lemon, Shipbottom, N.J.

[73] Assignee: U.S. Sound, Inc., Philadelphia, Pa.

[21] Appl. No.: 61,099

[22] Filed: Jun. 10, 1987

[51] Int. Cl.[4] ..... H04R 1/00

[52] U.S. Cl. ..... 381/156; 381/182; 181/145; 181/152

[58] Field of Search ..... 381/24, 88, 90, 182, 381/156, 205, 186, 89; 181/145, 152

[56] References Cited

U.S. PATENT DOCUMENTS

| | | | |
|---|---|---|---|
| 3,842,203 | 10/1974 | Weisberg | 381/182 |
| 3,931,867 | 1/1976 | Janszen | 381/182 |
| 4,469,921 | 9/1984 | Kinoshita | 381/156 |
| 4,503,553 | 3/1985 | Davis | 381/24 |
| 4,633,229 | 12/1986 | Iacono et al. | 381/24 |

OTHER PUBLICATIONS

RCA Solid State, "The Octophonic Amplifier. . . " Electronic Design, vol. 22, #8, Apr. 12, 1974, rear cover.

Tremaine, Audio Cyclopedia, 1969, pp. 1109–1110.

Community PC400 Series, Advertisement, Circa 1982.

Electro Voice Model HP640, Constant-Directivity Horn, Advertisement, Circa 1986.

Altec Mantaray, Advertisement, Circa 1985.

*Primary Examiner*—Forester W. Isen

*Attorney, Agent, or Firm*—Steele, Gould & Fried

[57] ABSTRACT

An improved method for transmitting sound at high power levels over a wide angle zone of dispersion without distortion, comprising the step of emitting sound waves from a plurality of individual sources, each characterized by a relatively narrow, wedge-shaped envelope of sound projection, such that adjacent edges of respective sound projection envelopes are in substantial alignment and do not overlap, whereby the absence of interference between sounds emitted from different sources precludes sound distortion and enables uniform sound dispersion and high sound quality throughout the zone. The sound waves are preferably emitted from electroacoustical loudspeakers having loudspeaker enclosures shaped to conform to the edges of their respective sound envelopes.

18 Claims, 2 Drawing Sheets

PRIOR ART
FIG. 1
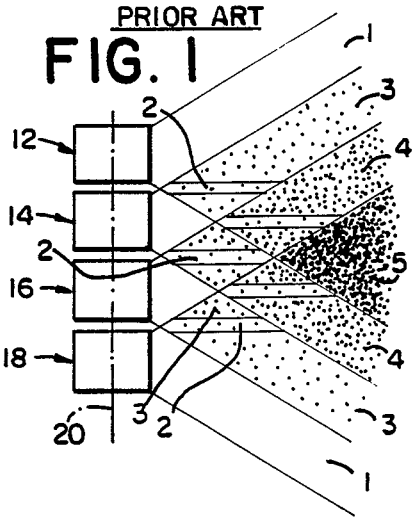
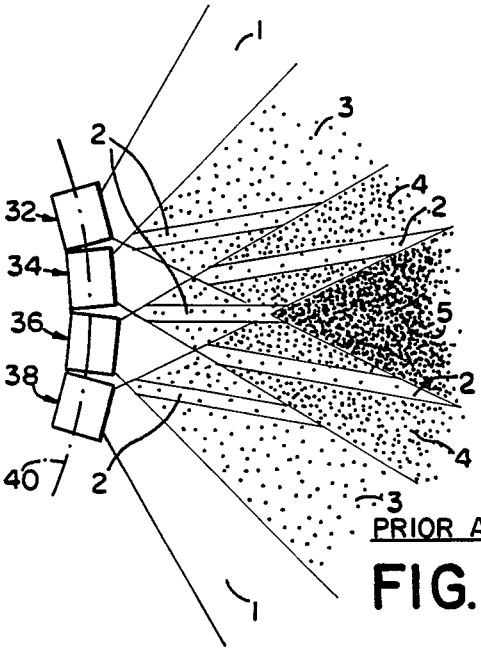
PRIOR ART
FIG. 2
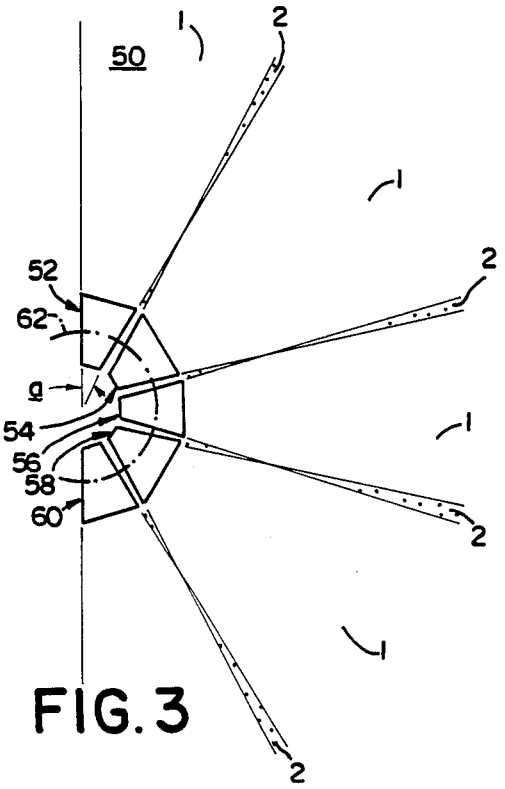
FIG. 3
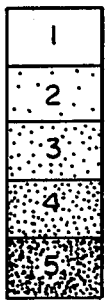
FIG. 4

METHOD FOR LARGE-SCALE MULTIPLE SOURCE SOUND REINFORCEMENT

BACKGROUND OF THE INVENTION

1. Field of the Invention

This invention relates to the field of multiple source high-power sound systems, and in particular, to high fidelity, high intelligibility sound transmission systems for concerts and the like.

2. Prior Art

Audio speaker systems of particularly high power are commonly used for concerts delivered in auditoriums, arenas and amphitheaters, both indoors and outdoors. Typically, individual speakers or "boxes" are stacked or "flown" in a large, closely spaced array in multiples. A typical "wall of sound" system as known in the prior art is shown in FIG. 1, and generally designated by reference numeral 10. A large array of speakers is often referred to as a "concert rig". The concert rig 10 comprises four speaker systems, designated 12, 14, 16 and 18, disposed on a straight line 20. Each speaker system comprises loudspeakers of different sizes and designs, which are appropriate for efficiencies in bass response, mid frequency response and high frequency response, respectively. The four speaker systems interact with one another, creating a plurality of different zones across the listening area or composite zone, wherein sound emitted by each of the speaker systems will remain pure and undistorted, or will be mixed with sounds emitted from one, two or three of the other speaker systems, creating sound confusion and loss of intelligibility. The principal cause of intelligibility loss in the arrival of sound from various sources at different times. Due to path length differences. The different zones are marked and shaded according to the chart shown in FIG. 4. The zones of purest sound are clear, without shading, and identified by the numeral 1. The least intelligible, most distorted sound is shaded the darkest, and identified by numeral 5. Pure sound, that is, sound which is emitted from only one source, and is not mixed with sound emitted from any other source, is transmitted along the outer edges of the zone and immediately in front of each of the speaker systems, as indicated by numeral 1. A number of short zones 2, known as "hi-fi alleys" are formed. The sound in each of the hi-fi alleys emanates from two sources, but inasmuch as the sound contribution from each of the two sources is substantially equal, the overall sound is of generally good quality. Zones designated by reference numeral 3 indicate sound confusion and loss of intelligibility due to unequal contribution from two sources. Zones marked by reference numeral 4 denote more confusion and loss of intelligibility, due to unequal contributions from three sources. The zone designated by reference numeral 5, which will be the single largest zone in the listening area, indicates maximum confusion and interference and maximum loss of intelligibility, due to unequal sound contributions from all four sources. It will be appreciated by those skilled in the art, and indeed by those who attend concerts where such concert rigs are utilized, that more than four speaker systems or sources are often used, for example six to eight sources for covering a wide angle zone of 100 degrees or more. Four sources are illustrated in FIG. 1 in order to reduce the difficulty of illustrating the problems of the prior art without unduly complicating the drawing.

A further difficulty stems from a demand perceived by the those presenting concerts to provide the maximum in sound level, which in turn requires the generation of high sound pressure levels and high dynamic range. Many concert boxes are literally filled with amplifiers and related devices in order to generate as much sound power as possible. Concert rigs such as that shown in FIG. 1 have, unfortunately for those presenting and attending concerts, become synonymous with load sound of inferior quality.

Some improvement has been achieved by a concert rig 30 as shown in FIG. 2, wherein each of the speaker systems or sources 32, 34, 36 and 38 are splayed outwardly from one another, being disposed upon a common arc or shallow curve 40. This arrangement has the effect of modestly increasing the size of the zones 1 of pure sound and the zones of hi-fi alleys 2 of equally mixed sounds. However, it is easily seen that the vast majority of the composite listening zone comprises sound zones designated 3, 4 and 5, which are of noticeably inferior quality. The angle between such splayed sources is typically between ten degrees and twenty degrees, and the system is intended to cover an overall zone of between sixty degrees and ninety degrees. The multiple overlap of sound generated by each of the typical concert rigs 10 and 30 shown in FIGS. 1 and 2 results in a highly unintelligible, acoustically blurred sound quality. Only those listeners who are very close to any one of the individual systems will receive relatively intelligible and undistorted sound. Such listeners are also likely to be deafened by the sound pressure levels.

This invention overcomes the difficulties of the prior art by providing a composite listening zone in which pure, unmixed, undistorted sound is delivered to virtually 100 percent of the listening zone, by emitting sound waves from a plurality of individual electroacoustical sources, each of a constant directivity type and characterized by a relatively narrow, wedge-shaped envelope of sound projection, such that adjacent edges of respective sound projection envelopes are in substantial alignement and do not overlap. The absence of interference between sounds emitted from different ones of the sources precludes sound distortion and enables uniform sound dispersion and high sound quality through the listening zone. Even the extent to which sound from adjacent sources may mix, it mixes equally in hi-fi alleys, a situation which provides at least good sound quality, if not the best sound quality. This can be appreciated by reference to the concert rig 50 shown in FIG. 3, which will be described in detail hereinafter.

SUMMARY OF THE INVENTION

It is an object of this invention to provide large-scale multiple source sound reinforcement delivering high fidelity sound throughout an entire listening zone.

It is another object of this invention to provide large-scale multiple source sound reinforcement delivering high intelligibility sound throughout the listening zone.

It is yet another object of the this invention to provide large-scale multiple source sound reinforcement without interference between any of the multiple sources.

It is yet another object of this invention to provide large-scale multiple source sound reinforcement employing zero-overlap sound projection from each of the sources.

These and other objects of the invention are accomplished by an improved method for transmitting sound at high power levels over a wide angle zone of dispersion without distortion, comprising the steps of: emitting sound waves from a plurality of individual sources, each of a constant directivity type and characterized by a relatively narrow, wedge-shaped envelope of sound projection; and, positioning the plurality of speakers in side by side relationship so that adjacent edges of respective sound projection envelopes are in substantial alignment and do not overlap, whereby the absence of interference between sounds emitted from any of the speakers precludes sound distortion and enables uniform sound dispersion and high sound quality throughout the zone. The method preferably comprises the further step of emitting sound waves from speakers having loudspeaker enclosures shaped to conform to the edges of their respective sound envelopes, such loudspeaker enclosures being thereby substantially trapezoidal in plan. In various preferred embodiments of the invention, the method further comprises the step of configuring each of the sound envelopes to define angles of sound dispersion which are less than or equal to approximately forty degrees, thirty degrees and even twenty degrees.

These and other objects of the invention are also accomplished by a speaker array for transmitting sound at high power levels over a wide angle zone dispersion without distortion, comprising a plurality of individual electroacoustical loudspeaker sources, each of a constant directivity type and characterized by a relatively narrow, laterally wedge-shaped envelope of sound projection, disposed in side by side relationship such that adjacent edges of respective sound projection envelopes are in substantial alignment and do not overlap, whereby the absence of interference between sounds emitted from different ones of the sources precludes sound distortion and enables uniform sound dispersion and high sound quality throughout the zone. In the presently preferred embodiment, the loudspeakers are disposed in a plurality of loudspeaker enclosures, each of the enclosures having a shape which conforms in plan to the edges of the envelope of sound projection generated by the loudspeakers disposed within the enclosure, such loudspeaker enclosures being thereby generally trapezoidal in plan.

BRIEF DESCRIPTION OF THE DRAWNGS

For the purpose of illustrating the invention, there are shown in the drawings forms which are presently preferred; it being understood, however, that the invention is not limited to the precise arrangements and instrumentalities shown.

FIG. 1 is a diagrammatic illustration of the sound interference patterns resulting from a linear wall of sound concert rig, according to the prior art;

FIG. 2 is a diagrammatic illustration of the sound interference patterns resulting from a splayed wall of sound concert rig, according to the prior art;

FIG. 3 is a diagrammatic illustration of the sound dispersion pattern of a concert rig in accordance with this invention;

FIG. 4 is a chart illustrating the scale of shading used for identifying the various degrees of sound purity and sound interference and distortion in the concert rigs of FIGS. 1, 2 and 3;

DETAILED DESCRIPTION OF THE PREFERRED EMBODIMENTS

Figure 5:
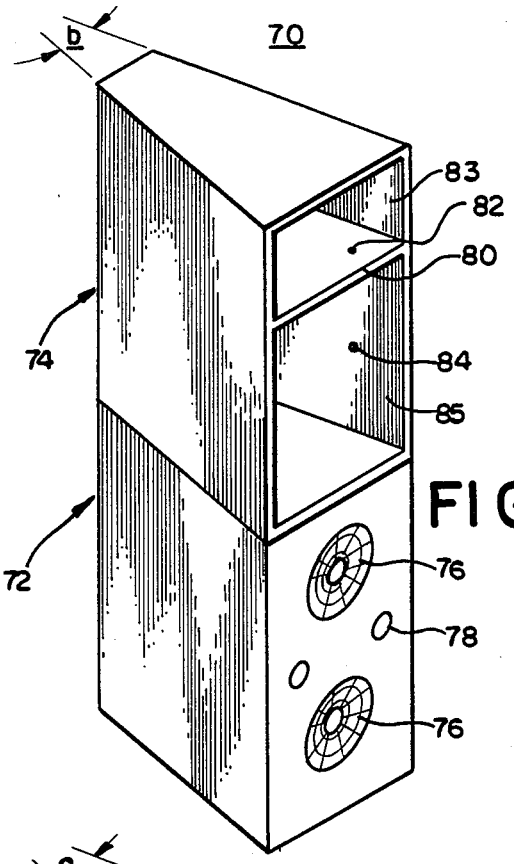
FIG. 5 is a perspective view of a speaker system source suitable for use in a concert rig as shown in FIG. 3; and, FIG. 6 is a perspective view of an alternative speaker system source to that shown in FIG. 5.

The operation of concert rig 50 in accordance with the principles of this invention is diagrammatically illustrated in FIG. 3. Sound is transmitted into a composite listening zone by a plurality of sound sources 52, 54, 56, 58 and 60. The composite listening area requires sound dispersion throughout an angle of approximately 180 degrees. Each of the sources 52 through 60 is designed to emit sound waves in a relatively narrow, wedge-shaped envelope of sound projection. In order for the five sources to cover the composite listening zone of 180 degrees, each of the sound sources must define a wedge-shaped envelope of sound projection having a dispersion angle a of approximately 36 degrees. The sounds are emitted radially outwardly from position on a substantially circular arc 62, if the sources are considered point sources or vertical line sources for purposes of illustration. As "real" speakers, the sources are disposed in side by side relationship along the substantially circular arc 62 so that adjacent edges of respective sound projection envelopes are in substantial alignment and do not overlap. With regard to the sound interference level chart shown in FIG. 4, and utilized in the description of the prior art systems of FIG. 1 and FIG. 2, it can be seen that each of the sources 52 through 60 generates a large zone 1 of pure sound, a narrow hi-fi alley 2 being formed between each of the zones 1. Whereas most of the composite listening zones in the prior art systems of FIGS. 1 and 2 consists of zones 3, 4 and 5, which are indicative of substantial interference and poor sound quality, almost all of the composite listening zone of the system shown in FIG. 3 is substantially pure, undistorted sound, the only deviation being the good sound quality of the narrow hi-fi alleys. The absence of interference between sounds emitted from any of the sources precludes sound distortion and enables uniform sound dispersion and high quality throughout the composite listening zone.

It is a further step of this invention to emit sound waves from sources or speakers having loudspeaker enclosures which are shaped to conform to the edges of their respective sound envelopes, referred to as a "minimum envelope" enclosure. Accordingly, each of the sources 52 through 60 is substantially trapezoidal in plan, whereas the loudspeaker enclosures of the sources used in the systems shown in FIGS. 1 and 2 are substantially rectangular. The triangular gaps between the splayed enclosures used in FIG. 2 result in acoustic diffculties on their own account.

A suitable speaker system for forming each of the sound sources 52 through 60 is shown in FIG. 5, and generally designated 70. Each such sound system is divided into two parts, a low frequency or "bass" speaker system 72 covering the frequency range of sound from approximately 35 Hz to 125 Hz and a "mid-high" speaker system 74 covering the frequency range from approximately 125 Hz to 20 KHz. Sounds at a frequency of approximately 20 KHz are at the very upper range of human hearing intelligibility. Separate amplifiers are used for the low, mid and high frequency loudspeaker components and an active crossover/e-qualizer control network is used to assign the appropriate signals to the appropriate amplifiers. Although the use of separate loudspeakers and crossover/equalizer networks is known in the art, the use of a mid-high speaker system, which essentially covers the entire range of intelligible sound, is a key to the invention's unusual sonic excellence and has never been used in concert rigs before. The mid-high unit operates with unusually small coverage angles, from as much as approximately 40 degrees horizontal dispersion to as little as 20 degrees horizontal dispersion. The angle of vertical dispersion is approximately 20 degrees.

Loudspeakers for the mid-high range speaker 72 must be of a constant directivity type, for example model EV-HP 420, available from Electro-Voice, Inc. of Buchanan, Mich. Inasmuch as the loudspeaker itself down not form a part of the invention, the loudspeaker is not shown in detail. A partition 80 divides the speaker 74 into an upper compartment 82 and a lower compartment 84. Upper compartment 82 is adapted to receive a high frequency loudspeaker 83, emitting sound in the range of approximately 1,100 Hz to 20 KHz. Compartment 84 is adapted to receive a mid frequency loudspeaker 85 for emitting sound in the range of approximately 125 Hz to 1,100 Hz. Those skilled in the art will appreciate that the preferred crossover point from bass speaker to mid-high speaker will vary according to circumstances, falling into the range of at least as low as 125 Hz and at least as high as 150 Hz.

The mid-high box 74 is substantially trapezoidal in plan, and defines a dispersion angle b of approximately 30 degrees. The mid-high speaker 74 rests on the bass speaker 72, which is a vented "bass box" having two bass loudspeakers 76 and two vents 78, the vents 78 being used to tune the bass box as is known in the art. The bass box 72 is also provided with a minimum envelope enclosure which conforms in plan to the dimensions and shape of the mid-high speaker 74. Even though the bass emissions are not subject to the same narrow envelopes of sound transmission, the minimum envelope shape contributes to the sound quality. Moreover, the narrow envelopes of sound provided by the special mid-high speakers control almost all of the spectrum of audible sound.

Figure 6:
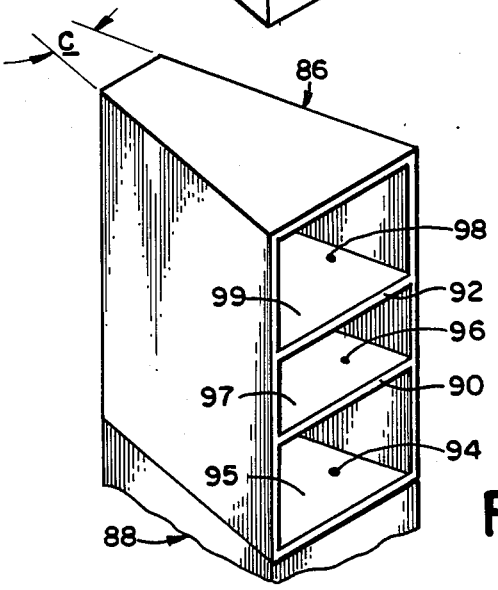

An alternative source is shown in FIG. 6, wherein a mid-high speaker 86 defines an envelope of sound projection having a dispersion angle c of only 20 degrees. In this embodiment, one mid frequency loudspeaker and two smaller mid frequency loudspeakers are utilized. Partitions 90 and 92 divide the mid-high speaker into compartments 94, 96 and 98. Compartments 94 and 98 receive mid frequency loudspeakers 95 and 99 operating in the range of approximately 150 Hz to 1,100 Hz. Compartment 96 receives a high frequency loudspeaker 97, operating in the range of approximately 1,100 Hz to 20 KHz. A vented bass box 88 is similar to bass box 74 shown in FIG. 5, except for having a minimum envelope enclosure corresponding to the angle of dispersion c of mid high speaker 86 and having a maximum preferred frequency of 150 Hz.

Extreme wide band directivity control is achieved, and a "house" engineer can so arrange the array of speaker sources that individual areas in an audience are covered with minimum overlap or interference from adjacent sources. Even the transition zones, the hi-fi alleys between sources, are acoustically very well behaved. Total zone control within the composite listening zone is possible for the first time. Both sound level, particularly in the critical intelligibility band of 500 Hz to 2,000 Hz, and frequency response can be tailored for each zone. For example, listeners in distant seats will require high output from a source and more frequency "boost" to perceive the same sound quality and level as listeners closer to the source. Moreover, dramatic improvements in stereophonic "image" can be achieved by "skewing" the directivity patterns of "left" and "right" arrays, each array formed by plural sources as described herein. The stereo image can be made effective to a much larger part of the audience, and in fact, to most of the audience. Such stereophonic imaging is simply impossible to achieve when most of a composite listening zone is filled with overlapping and confused sound dispersion patterns from multiple sources.

The use of a mid-high speaker as described enables the highest possible sound pressure levels to be developed for a given input power. The use of smaller capacity loudspeakers, even in slightly larger numbers, reduces system cost, as less amplification is needed to achieve desired sound levels and quality. In most cases, the system can "coast", particularly in the "vocal" range. The system provides universally clear sound reinforcement with low distortion and wide dynamic range.

Overall, the reinforcement of sound from multiple sources according to this invention is particularly advantageous, in providing: non-overlap zonal coverage; lightweight design; convenient system packing for similarly shaped bass and mid-high speaker boxes; and, the use of vented enclosure technology for the bass boxes. The non-overlap zonal coverage enables listeners to hear sound from only one source, providing the best intelligibility. The high directivity results in minimum reverberation and the design of the horns in the loudspeakers provides maximum efficiency for the lowest distortion and minimum power requirements. Sound quality uniformity in various audience zones can be obtained and the stereo image can be vastly improved throughout a much larger portion of the composite listening zone.

The invention can be embodied in other specific forms without departing from the spirit or essential attributes thereof, and accordingly, reference should be made to the appended claims, rather than to the foregoing specification, as indicating the scope of the invention.

What is claimed is:

1. An improved method for transmitting sound at high power levels over a wide angle zone of dispersion without distortion, comprising the steps of:

emitting sound waves from a plurality of individual sources, each source having a constant acoustic power output at a predetermined angle of divergence and over a predetermined frequency range covering substantially a full audio range of frequencies above approximately 125 to 500 Hz, the sources being of a constant-directivity type and characterized by a relatively narrow, wedge-shaped envelope of sound projection with an angle of sound dispersion not more than approximately forty degrees; and, positioning the plurality of said individual sources in side-by-side relationship so that adjacent edges of respective sound projection envelopes are in substantial alignment and do not overlap, whereby the absence of interference between sounds emitted from any of the sources preclude sound distortion and enables sound dispersion and high sound quality throughout the zone.

2. The method of claim 1, wherein each said source has sections for distinct frequency ranges, the sections likewise emitting sound at constant-directivity over said predetermined angle of divergence.

3. The method of claim 2, wherein sound is emitted from a mid frequency source and a high frequency source, and further comprising the step of dividing signals into said mid frequency source and high frequency source using a cross-over network.

4. The method of claim 1, wherein said individual sources are electroacoustical loudspeakers having loudspeaker enclosures shaped to conform to the edges of their respective sound envelopes.

5. The method of claim 4, comprising the further step of forming each loudspeaker enclosure to be substantially trapezoidal in plan.

6. The method of claim 1, further comprising the step of emitting the sounds radially outwardly from positions on a substantially circular arc.

7. The method of claim 1, comprising the step of configuring each of the sound envelopes to define an angle of sound dispersion which is not more than approximately thirty degrees.

8. The method of claim 3, comprising the step of configuring each of the sound envelopes to define an angle of sound dispersion which is not more than approximately twenty degrees.

9. The method of claim 1, further comprising the steps of emitting the sound waves from two arrays of the plurality of sources and skewing the sounds emitted from the arrays to achieve stereophonic imaging throughout a large portion of the dispersion zone.

10. An improved method for transmitting sound at high power levels over a wide angle zone of dispersion without distortion, comprising the steps of emitting sound waves from a plurality of individual constant-directivity sources, each source having a constant acoustic power output at a predetermined angle of divergence and over a predetermined frequency range covering substantially a full audio frequency range above approximately 125 to 500 Hz, the individual sources being characterized by a relatively narrow, wedge-shaped envelope of sound projection with an angle of sound dispersion not more than approximately forty degrees, such that adjacent edges of respective sound projection envelopes are in substantial alignment and do not overlap, whereby the absence of interference between sounds emitted from different sources preclude sound distortion and enables uniform sound dispersion and high sound quality throughout the zone.

11. The method of claim 10, comprising the step of configuring each of the sound envelopes to define an angle of sound dispersion which is not more than approximately thirty degrees.

12. The method of claim 11, comprising the step of configuring each of the sound envelopes to define an angle of sound dispersion which is not more than approximately twenty degrees.

13. The method of claim 10, wherein the sources are electroacoustical loudspeakers having loudspeaker enclosures shaped to conform to the edges of their respective sound envelopes.

14. The method of claim 13, comprising the further step of forming each loudspeaker enclosure to be substantially trapezoidal in plan.

15. The method of claim 10, further comprising the step of emitting the sounds radially outwardly from positions on a substantially circular arc.

16. The method of claim 10, further comprising the steps of emitting the sound waves from two arrays of the plurality of sources and skewing the sounds emitted from the arrays to achieve stereophonic imaging throughout a large portion of the dispersion zone.

17. The method of claim 10, wherein each said source has sections for distinct frequency ranges, the sections likewise emitting sound at constant-directivity over said predetermined angle of divergence.

18. The method of claim 17, wherein sound is emitted from a mid frequency source and a high frequency source, and further comprising the step of dividing signals into said mid frequency source and high frequency source using a cross-over network.

* * * * *